US007371147B2

(12) United States Patent
Tusacciu

(10) Patent No.: US 7,371,147 B2
(45) Date of Patent: May 13, 2008

(54) SYSTEM FOR REALISING COMPLEX ASSEMBLIES

(76) Inventor: Edoardo Tusacciu, Via Sabotino, 20, 07023, Calangiaus (SS) (IT)

( * ) Notice: Subject to any disclaimer, the term of this patent is extended or adjusted under 35 U.S.C. 154(b) by 0 days.

(21) Appl. No.: 11/178,805

(22) Filed: Jul. 12, 2005

(65) Prior Publication Data

US 2006/0014467 A1 Jan. 19, 2006

(30) Foreign Application Priority Data

Jul. 19, 2004 (IT) ..... RM2004A0362

(51) Int. Cl.
*A63H 33/04* (2006.01)
*A63H 33/12* (2006.01)
*A63H 33/08* (2006.01)

(52) U.S. Cl. ..... 446/85; 446/92; 446/122; 446/126

(58) Field of Classification Search ..... 446/92, 446/102, 108, 116, 120, 126, 137, 138–139, 446/85, 122, 123
See application file for complete search history.

(56) References Cited

U.S. PATENT DOCUMENTS 1,198,263 A * 9/1916 Pajeau ..... 446/126
1,198,623 A * 9/1916 Pajeau ..... 15/41.1
2,962,820 A * 12/1960 Petersen ..... 434/278
2,970,388 A * 2/1961 Yonkers ..... 434/277
3,458,949 A * 8/1969 Young ..... 446/124
3,475,023 A * 10/1969 Fauvelle ..... 482/82
3,998,003 A * 12/1976 Rosenbaum ..... 446/119
4,129,975 A * 12/1978 Gabriel ..... 52/655.2
4,629,192 A * 12/1986 Nichols ..... 273/156
4,781,644 A * 11/1988 Yoshida ..... 446/123
5,487,691 A * 1/1996 Chiu ..... 446/126
5,769,681 A * 6/1998 Greenwood et al. ..... 446/120
6,491,563 B1 * 12/2002 Bailey ..... 446/122
6,626,727 B2 * 9/2003 Balanchi ..... 446/85
6,672,789 B2 * 1/2004 Chen ..... 403/171
6,702,641 B2 * 3/2004 Oakley ..... 446/92
2004/0043164 A1 * 3/2004 Vicentelli ..... 428/34.1

FOREIGN PATENT DOCUMENTS

DE 10207244 C1 * 5/2003

* cited by examiner

*Primary Examiner*—Eugene Kim
*Assistant Examiner*—Alyssa M Hylinski
(74) *Attorney, Agent, or Firm*—Dickstein, Shapiro, LLP.

(57) ABSTRACT

The invention concerns a system for realizing complex constructions, characterized in that it comprises a plurality of basic elements, and a plurality of constructive and/or figurative elements, that can be coupled with said basic elements, each basic element being comprised of ferromagnetic material, to be coupled with a first type of constructive and/or figurative magnetic elements, said basic elements being further provided with not-magnetic coupling means, for coupling with at least a second type of plastic material elements, said plastic material elements being provided with coupling means corresponding to the coupling means provided on said plurality of basic elements.

26 Claims, 9 Drawing Sheets

SYSTEM FOR REALISING COMPLEX ASSEMBLIES

The present invention relates to a system for realising complex assemblies.

More specifically, the invention concerns to a system of the above kind, allowing to realise every kind of complex assembly, starting from a basic element allowing the coupling of other elements when realising the assembly by magnetic coupling, fixed joint, screwing, etc.

In the following specification, basic element means every kind of element, preferably a sphere, but that can have a different shape, comprised of ferromagnetic material, so as to allow the coupling of magnetic elements, and it is provided with fixed joint means, or screwing means for coupling further elements comprised of flexible or rigid plastic material, said elements being of any shape or size according to the specific assembly that it is wished realising. Many solutions have been realised during last decades for realising constructions. Among them, in the last 70 years, surely the one with the best success is the Lego® system. At the beginning, said system provided a series of little bricks, having different dimensions, all provided with the same coupling system, allowing, if properly combined, to realise structures, particularly buildings, more or less different, but in any case with rather standardised shapes.

Afterwards, the system has been integrated by always more differentiated solutions that, always based on the well known Lego® coupling system, allow realising always more complex structures, as well as always more real shapes.

Without wishing telling all the story of Lego® system evolution, it is based on realisation of personages, special pieces, ecc., all linked by the same coupling concept with the basic structure. Substantially, thousands of different pieces have been realised, allowing realising very realistic complex structures, all the pieces being coordinated by the characteristic Lego® system coupling.

Moreover, different solutions have been suggested in the recent years based on the interaction between magnetic elements and ferromagnetic elements, for realising complex figures.

Substantially, it is a combination of bars, having magnetic ends, or completely magnetic bars, combined with ferromagnetic elements, or spheres, in different ways for realising complex figures.

In the first macro category providing bars with magnetic ends must be considered as included toys known on the market with the name Roger's Connection, providing bars, all having the same sizes, comprised of two magnets separated by an air gap, or those marketed under the trade name Geomag®, the bars of which are comprised of a combination of magnet—Ferro magnet—magnet. In both cases complex figures are realised by employing ferromagnetic spheres.

In the second macro-category it must be considered as included the product known on the market as Supermag®, patented and realised by the same Applicant, providing bars with different sizes, and completely comprised of magnetic material. Supermag® has realised a remarkable improvement with respect to the known solutions, both as far as the possibility of realising always more complex figures, as well as for sturdiness of the obtained figures.

However, even by the introduction of Supermag®, that, as already said, has remarkably improved and "broadened" playability of this kind of systems, it is still not possible realising each kind of figure, but employing a very high number of pieces, and with very high costs.

Furthermore, figures that can be realised by this kind of assemblies are limited to the figures that can be realised employing bars, with different dimensions, and balls, with different dimensions, i.e. the elements available with Supermag®.

It is absolutely not possible providing to the child, or in any case to the user of the elements, a "system" allowing creating a structure, an assembly, such as, for example, a town, a factory, a space vessel, and so on, always basing on the use of magnetic elements and of ferromagnetic elements.

Main object of the present invention is that of providing a solution allowing, starting from a basic element, realising every kind of structure, figure or assembly.

Further object of the present invention is that of providing a system of the above kind, based on the combination of a kind of basic element allowing magnetic and/or inner or outside fixed joint coupling, and/or by screwing coupling, with magnetic elements and/or with rigid or flexible plastic material elements.

Still another object of the present invention is that of providing a system of the above kind, allowing realising constructive assemblies based on the coupling between said basic element and a base provided with one or more fixed joint seats.

It is therefore specific object of the present invention a system for realising complex constructions, characterised in that it comprises a plurality of basic elements, and a plurality of constructive and/or figurative elements, that can be coupled with said basic elements, each basic element being comprised of ferromagnetic material, to be coupled with a first type of constructive and/or figurative magnetic elements, said basic elements being further provided with not-magnetic coupling means, for coupling with at least a second type of plastic material elements, said plastic material elements being provided with coupling means corresponding to the coupling means provided on said plurality of basic elements.

Preferably, according to the invention, said basic elements are comprised of spherical shape, regular polyhedric shape, irregular polyhedric shape, or of any other suitable shape.

Furthermore, according to the invention, said basic elements provide one, two, three, four, five or six coupling not-magnetic means.

Particularly, said not-magnetic coupling means can be comprised of threaded holes, of fixed joint holes, through holes, blind holes.

Always according to the invention, said first kind of constructive and/or figurative elements is comprised of substantially elongated elements, preferably bars having at least their ends comprised of magnetic material.

Still according to the invention, structures or figures can be provided on said substantially elongated elements.

Furthermore, according to the invention, said second type of constructive and/or figurative elements can be comprised of rigid or flexible plastic material.

Always according to the invention, said second type of constructive and/or figurative elements can have a substantially elongated shape.

Further, according to the invention, said second type of constructive and/or figurative elements can have the shape of an object, of a personage, of a figure, or of part of the same.

Said not-magnetic coupling means can be comprised of a fixed joint provided on said second type of constructive and/or figurative elements, coupling outside said basic element.

Furthermore, shaped elements can be provided, coupling with said first and/or second type of constructive and/or figurative elements or with said basic elements, or with a combination of the same, partially or completely reproducing a figure or element, or part of the same.

Still according to the invention, elements can be provided that can be fixedly coupled outside said basic elements.

Said elements are preferably comprised of plastic material.

Furthermore, basic elements with different dimensions can be provided.

According to the invention, basic elements provided with a through hole can be provided, said hole being sized in such a way to fit outside said substantially elongated shape second type of constructive and/or figurative elements.

An embodiment of the system according to the invention provides constructive and/or figurative elements comprised of a flexible elongated element, that can be introduced within the holes of said basic elements, shaped or figurative elements being provided that can be inserted outside said flexible elongated element.

Still according to the invention, the system can provide a substantially bidimensional base, shaped or not shaped, or a base, shaped or not shaped with a thickness substantially lower with respect to the other two dimensions, and provided with seats for fixed or removable coupling of said basic elements.

According to another embodiment of the system according to the invention, it can provide a substantially bidimensional base, shaped or not shaped, or a base, shaped or not shaped with a thickness substantially lower with respect to the other two dimensions, and provided with basic elements directly built in the same base.

Preferably, according to the invention, said basic elements are comprised of steel, or of nickel-plated material.

The present invention will be now described, for illustrative but not limitative purposes, according to its preferred embodiments, with particular reference to the figures of the enclosed drawings, wherein.

Figure 12A:
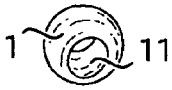
Figure 12B:
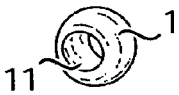
Figure 12C:
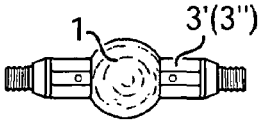
Figure 13:
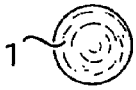
Figure 13:
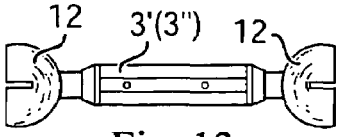
Figure 13:
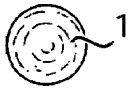
Figure 14A:
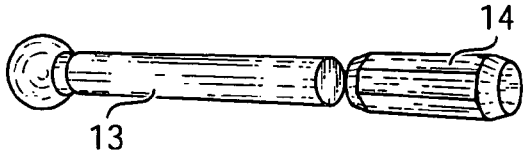
Figure 14B:
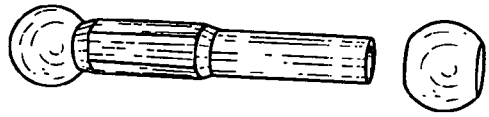
Figure 14C:
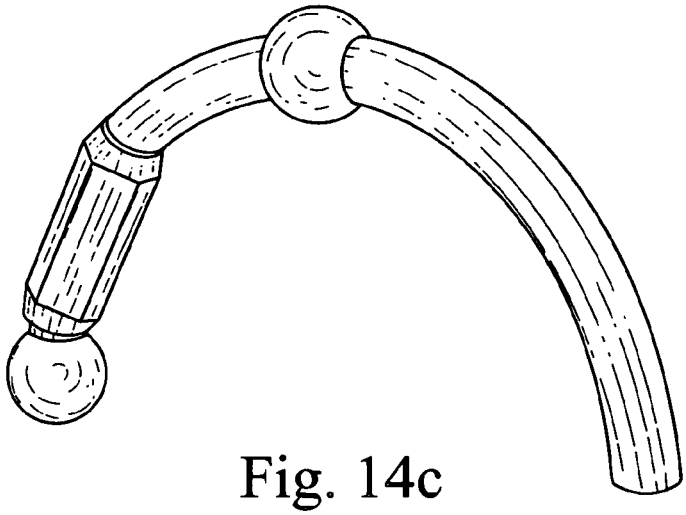
Figure 15A:
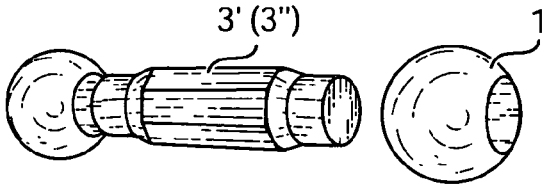
Figure 15B:
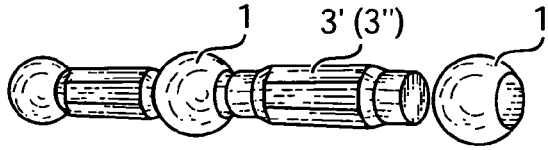
Figure 15C:
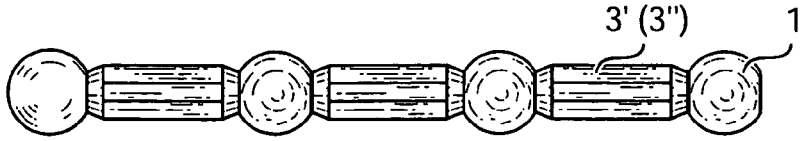

FIGS. 8*a*-8*h* show some embodiments of the basic elements of the system according to the invention;

FIGS. 9*a*-9*e* show a kind of basic elements with a corresponding constructive element;

FIGS. 10*a*-10*e* shows further embodiments of the basic element of the system according to the invention;

FIGS. 11*a*-11*e* show a kind of basic elements with a corresponding constructive element;

FIGS. 12*a*-12*c* show a perspective view of a further type of basic element, positioned outside a constructive element;

FIG. 13 is an exploded view of a further basic element—constructive element combination according to the invention;

FIGS. 14*a*-14*c* show an assembly sequence of a further basic element—constructive element combination according to the invention;

FIGS. 15*a*-15*c* show an assembly sequence of a further basic element—constructive element combination according to the invention.

In the following, the specification will refer to basic elements comprised of a sphere, but it is well evident that they can have a different shape, this not being out of the scope of the present invention.

Some structures that can be realised by the system according to the invention are shown in FIGS. 1-7, while some examples comprising the system according to the invention are shown in the following figures.

However, it is preliminary wished to observe that what has been and will be described is only a minimum part of the possible almost infinite solutions that can be obtained by the system according to the invention, realising and designing elements with every shape and function, that can be coupled, as described in the following, with one or more basic elements.

As it will be noted from the following specification, the solution according to the invention is based on the inventive concept of realising, starting from a basic element, represented in the enclosed figures as a sphere, but that could have a different shape, every kind of more or less complex structure.

In fact, sphere, or basic element, allows coupling every kind of constructive and/or figurative element, either by magnetic coupling or by fixed joint or screwing.

Possibility of employing the second type of constructive and/or figurative elements, comprised of rigid or flexible material, coupled by fixed joint or screwing with the sphere, allows realising a more "playable" and rigid structure, with respect to those comprised only of spheres and magnetic bars.

Furthermore, said second type of constructive and/or figurative elements can be realised by remarkably lower costs with respect to the classic magnetic bars, so that, by the solution according to the present invention, it is possible obtaining a complex figure or structure more faithful to the real one, and with reduced costs.

Still, said second type of constructive and/or figurative elements can be realised reproducing every shape necessary for realising a complex structure or figure, for example a tree, a bush, a personage or an animal, part of a vehicle, ecc, thus increasing faithfulness of reproduction of the structure or figure.

In case it is necessary realising connections according to different directions with respect to axes x, y, z, sphere, or in any case the basic element, being comprised of ferromagnetic material, allows coupling one end of the magnetic bar, for example a Supermag® bar.

Furthermore, as it will be noted in the following, it is possible realising elements coupling with the sphere, such as tyres.

From the above short description, it can be understood that the sphere, or another type of basic element, is the constructive "knot" of the system according to the invention.

Observing now figures of the enclosed drawings, the first FIGS. 1-7 show some figures that can be realised by the system according to the invention.

Particularly, it can be noted that using a plurality of spheres 1, that will be described in greater detail in the following, and combining them with magnetic constructive and figurative elements 2, and with plastic material, second type, constructive elements, respectively rigid 3' or flexible 3", it is possible realising very complex figures.

Figure 1:
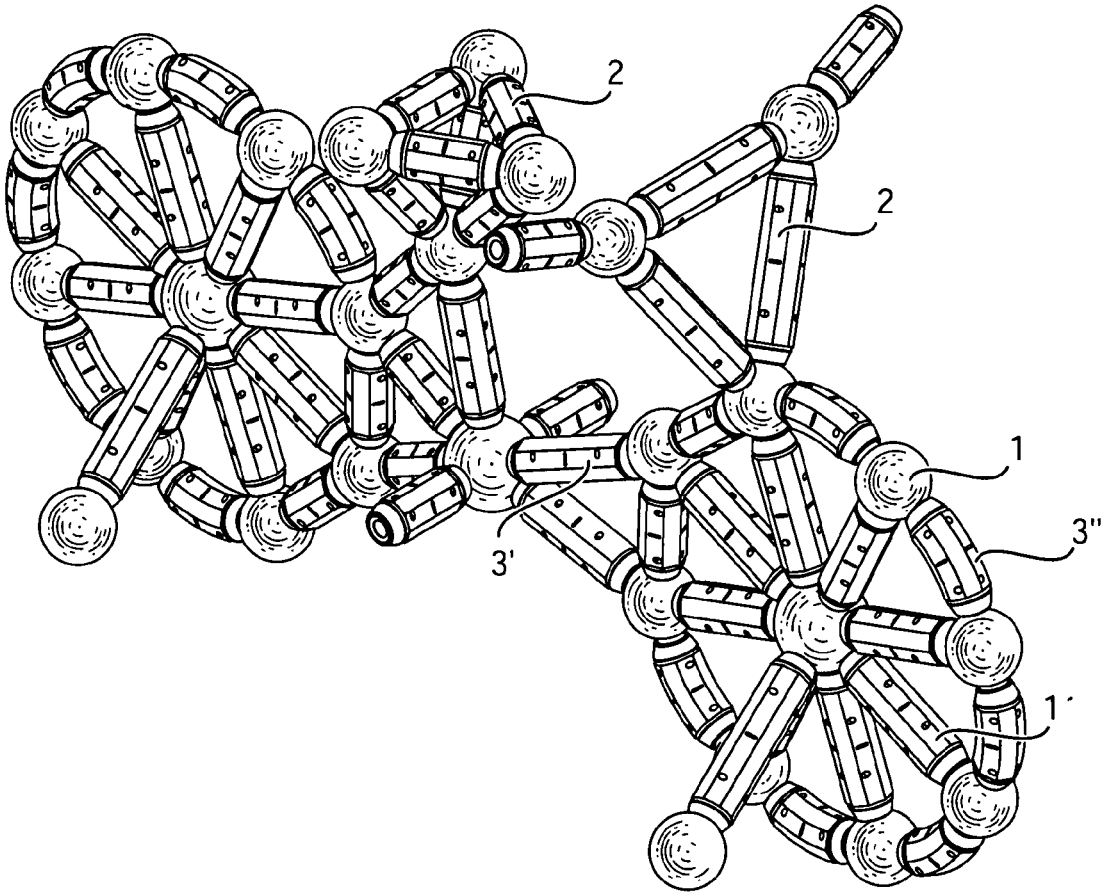
FIG. 1 shows a first example of a structure realised by the system according to the invention.
Figure 2:
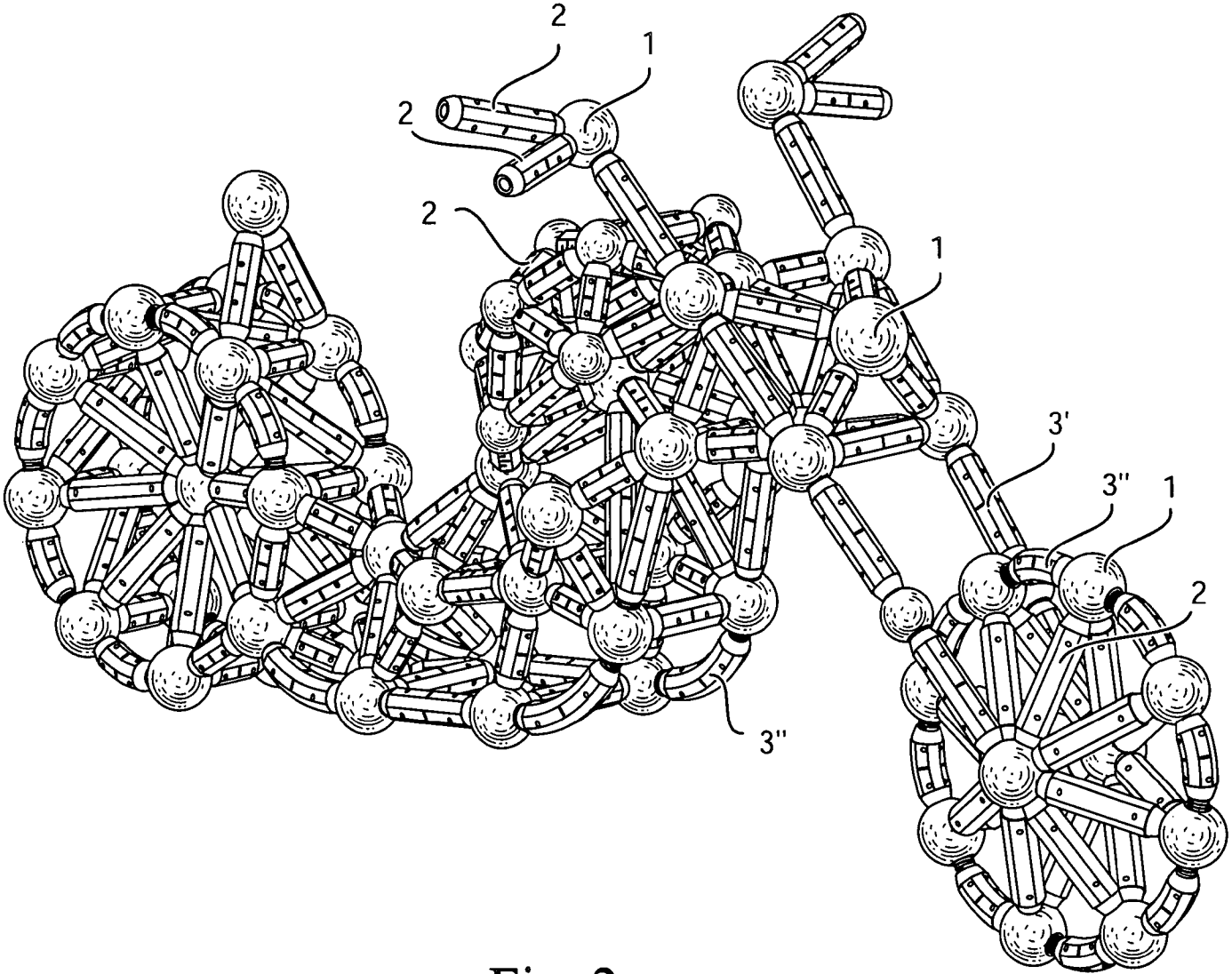
FIG. 2 shows a second example of a structure realised by the system according to the invention.

Although it is not shown in the figures, for example the structure of the seat of the bicycle shown in FIG. 1, as well as other structures of the figures, instead being realised by a plurality of magnetic bar elements 2 and spheres 1, could also be replaced by a real moulded seat, and coupled with a sphere 1 comprising the base of the same seat.

Figure 3:
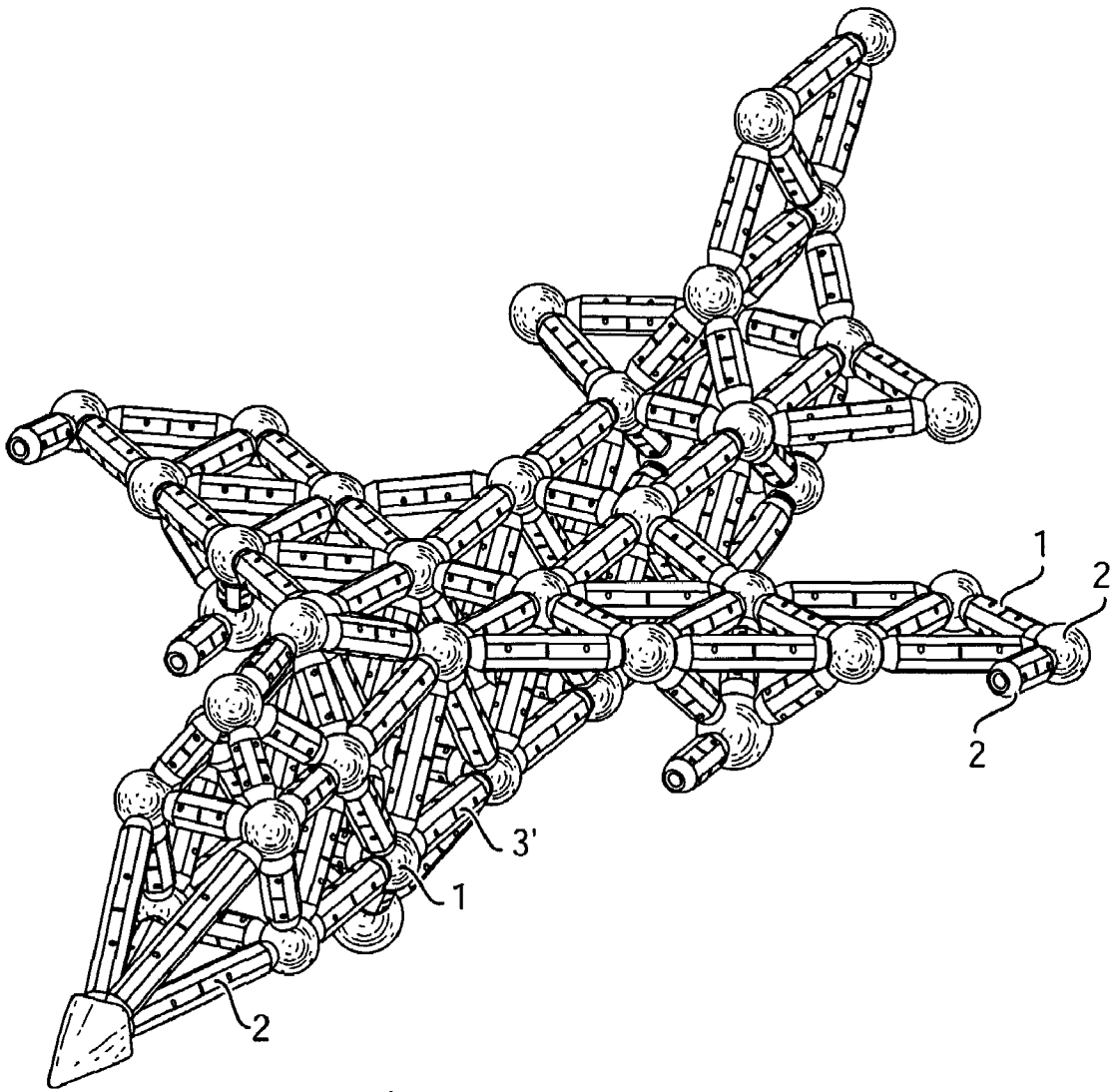
FIG. 3 shows a third example of a structure realised by the system according to the invention.
Figure 4:
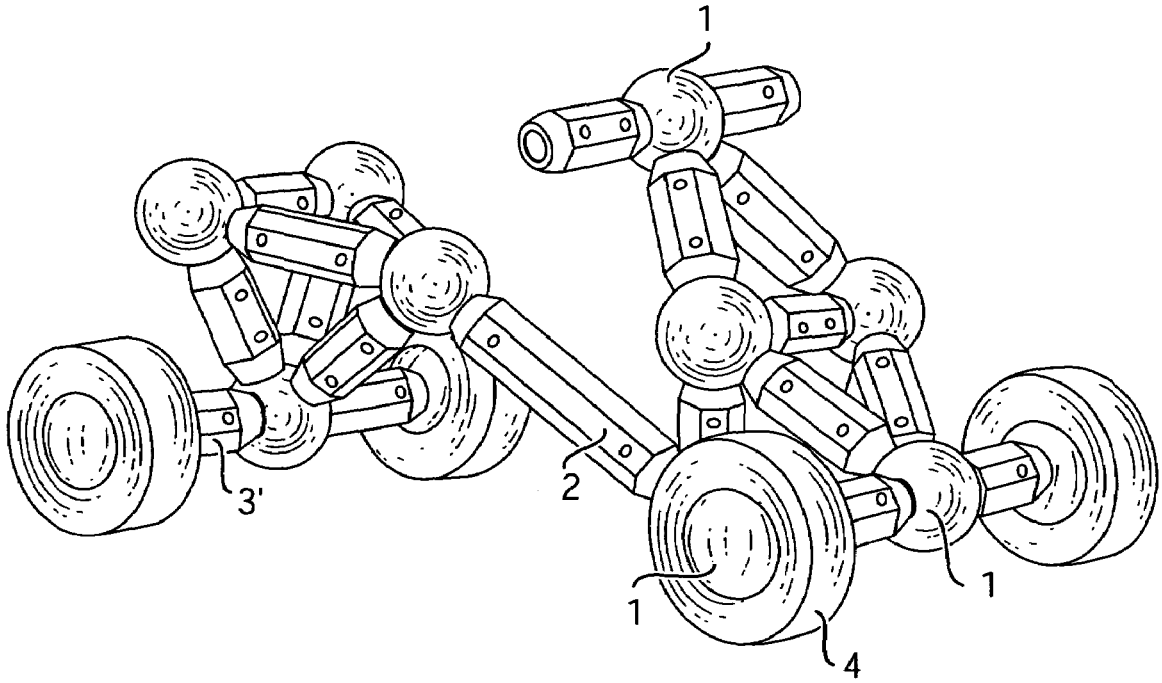
FIG. 4 shows a fourth example of a structure realised by the system according to the invention.
Figure 5:
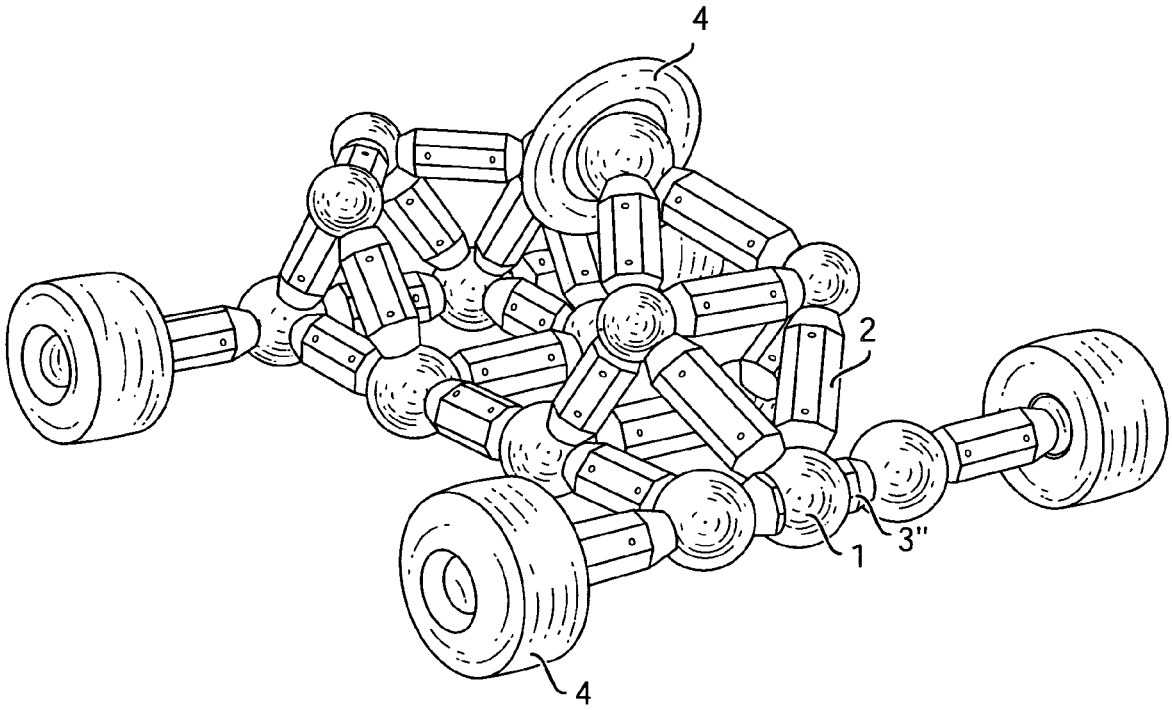
FIG. 5 shows a fifth example of a structure realised by the system according to the invention.

Also the tip of the airplane shown in FIG. 3 could be replaced by a single plastic moulded element fixed to the spheres 1. the same applies for example for the seat of the vehicle of FIG. 4.

Always in FIG. 4 it can e noted the realisation of wheels 4, coupling outside the spheres 1 Instead of the wheels 4, other elements could be realised on the basis of the figure to be realised.

Figure 6:
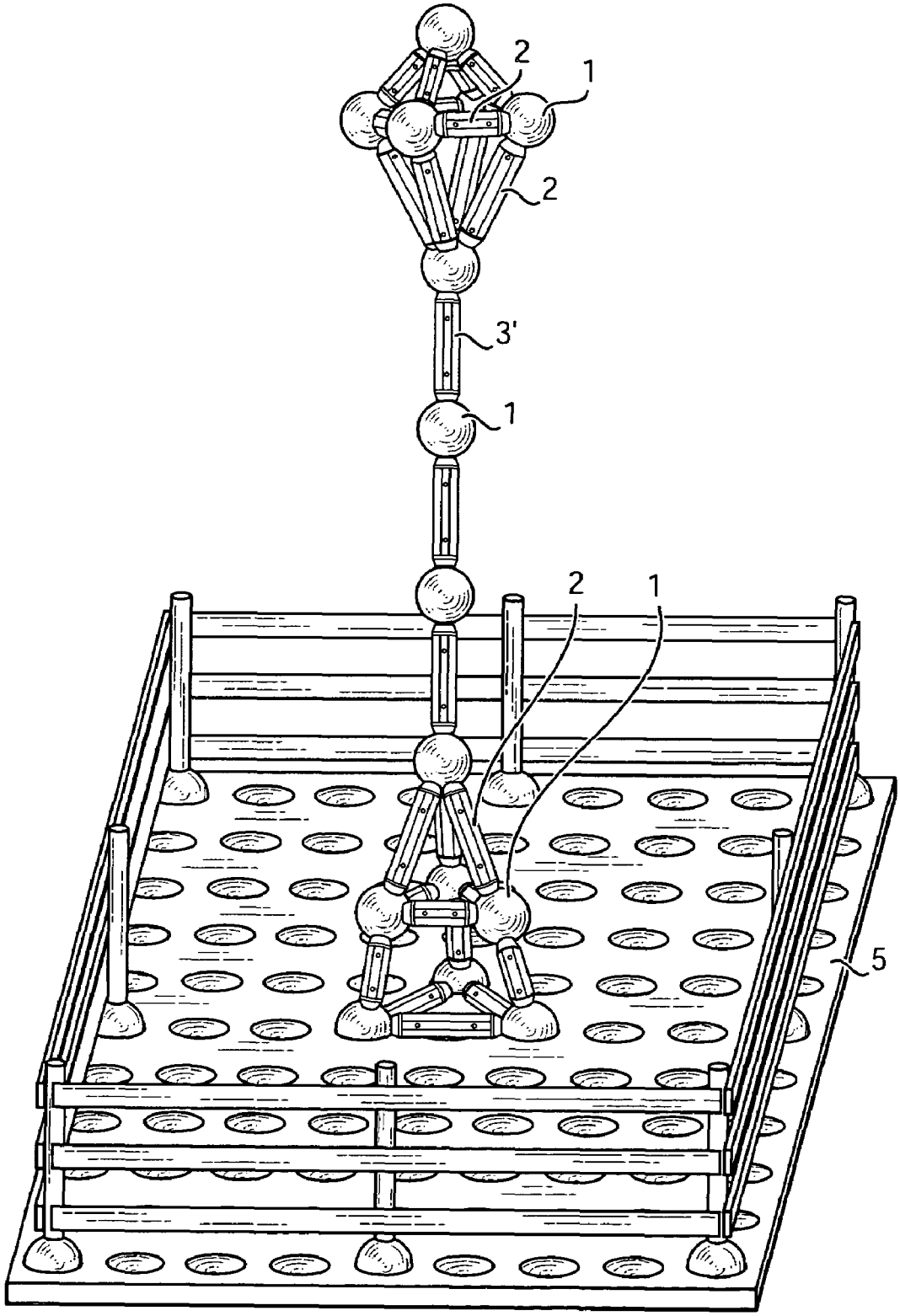
FIG. 6 shows a sixth example of a structure realised by the system according to the invention.
Figure 7:
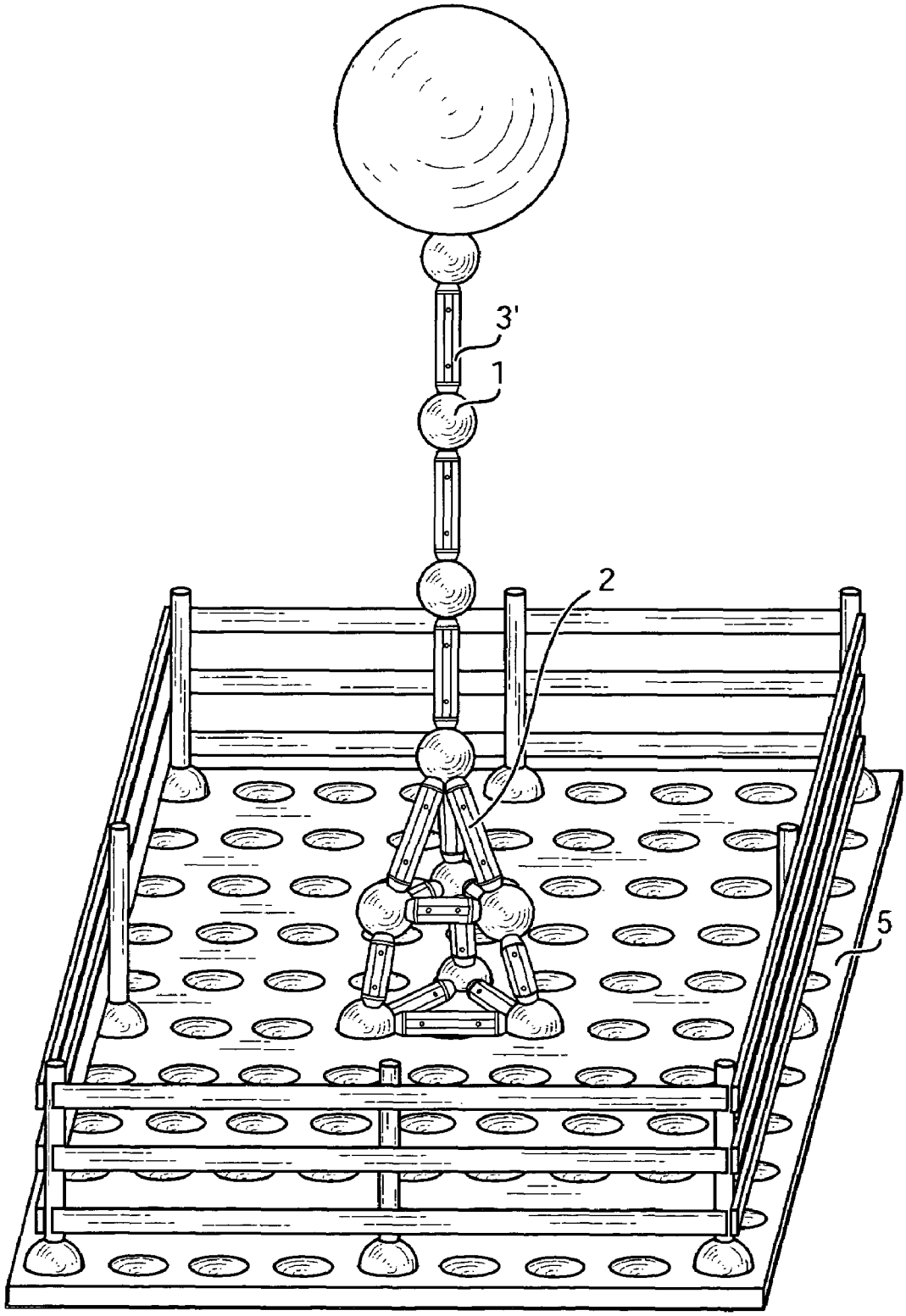
FIG. 7 shows a seventh example of a structure realised by the system according to the invention.

As it is shown in FIGS. 6 and 7, the system according to the invention can also provide a base 5, provided with seats for coupling the spheres 1, or other type of basic elements, or said basic elements could be already fixed to the base 5, in order to be able to realise the various figures, starting from said basic elements 1.

Coming now to observe in greater detail FIGS. 8-13 of the enclosed drawings, FIGS. 8*a*-8*e* show a basic element 1, or sphere, provided with a blind threaded hole 6 (FIG. 8*a*), two blind threaded holes (FIG. 8*b*), three blind threaded holes (FIG. 8*c*), four blind threaded holes (FIG. 8*d*), six blind threaded holes (FIG. 8*e*), all realised according to the axes x, y, z of a reference system placed on sphere 1.

Figure 8A:
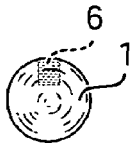
Figure 8B:
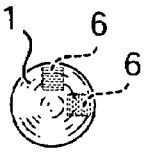
Figure 8C:
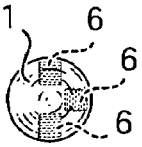
Figure 8D:
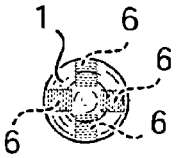
Figure 8E:
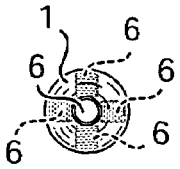
Figure 8F:
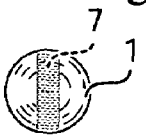
Figure 8G:
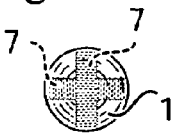
Figure 8H:
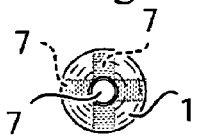
Figure 9A:
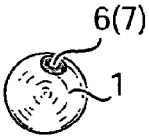
Figure 9B:
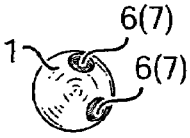
Figure 9C:
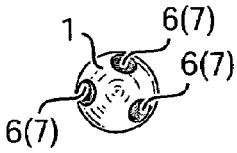
Figure 9D:
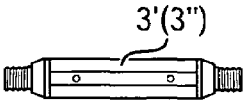
Figure 9E:
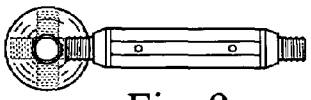
Figure 10A:
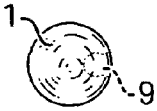
Figure 10B:
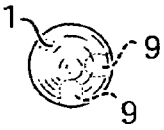
Figure 10C:
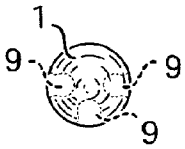
Figure 10D:
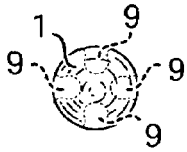
Figure 10E:
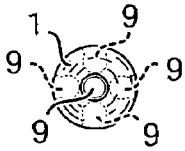

One, two, and three through threaded holes 7 are respectively shown in FIGS. 8*f*-8*h*, always realised according to the axes x, y, z of a reference system placed on sphere 1.

Coupling of the rigid or flexible, plastic, constructive and/or figurative element 3' (3") with sphere 1 provided with threading 6 (7) is shown in FIGS. 9*a*-9*e*. As already mentioned in the above, said element 3' (3") could also be comprised of a plastic material complex figure.

Coming now to observe in greater detail FIGS. 10*a*-10*e*, it is shown a basic element 1, or sphere, provided with a blind hole (FIG. 9*a*), two blind holes (FIG. 9*b*), three blind holes (FIG. 9*c*), four blind holes (FIG. 9*d*), six blind holes (FIG. 9*e*), all realised according to the axes x, y, z of a reference system placed on sphere 1.

Coupling of the rigid or flexible, plastic, constructive and/or figurative element 3' (3") with sphere 1 provided with threading 6 (7) is shown in FIGS. 11*a*-11*e*. As already mentioned in the above, said element 3' (3") could also be comprised of a plastic material complex figure.

Figure 11A:
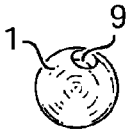
Figure 11B:
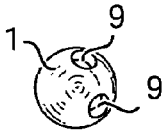
Figure 11C:
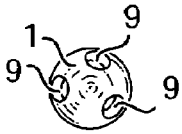
Figure 11D:
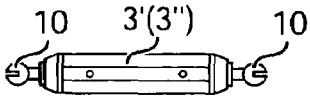
Figure 11E:
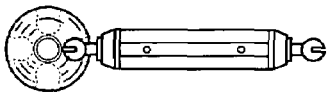

A particular embodiment of the basic element 1, or sphere is shown in FIGS. 12*a*-12*c*, said element 1 being provided with a through hole 11, sized so as to allow its positioning outside an elongated constructive and/or figurative element (FIG. 11*d* shows an element 3' (3")). An application of this embodiment can be seen from FIG. 4. By this solution, it is possible coupling a magnetic bar along a not-magnetic element 3' or 3", thus obtain an even better playability of the system.

Solution shown in FIG. 13 provides a coupling system 12 fixedly coupling outside the sphere 1, for example for realising articulation of a trailer, or similar connections.

System according to the invention shown in FIG. 14*a*-14*c* provides an elongated flexible element 13, sleeves 14, inserting on said element 13, spaced with holed spheres 1.

Finally, FIGS. 15*a*-15*c* show the coupling between sphere 1 and element 3' (3") obtained by forcing the end of the element 3' (3") within the sphere 1 hole.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A system for realizing a complex construction, the system comprising:

a plurality of basic elements, and a plurality of first type of constructive and/or figurative magnetic elements and of second type of constructive and/or figurative plastic non-magnetic material elements, which can be coupled with said basic elements, wherein each basic element is comprised of ferromagnetic material, to be coupled with said first type of constructive and/or figurative magnetic elements, wherein said basic elements are further provided with non-magnetic coupling means, for coupling with said second type of plastic non-magnetic material elements, said plastic material elements being provided with coupling means corresponding to the coupling means provided on said plurality of basic elements.

2. The system for realizing complex constructions according to claim 1, wherein said basic elements are comprised of spherical shape, regular polyhedric shape, irregular polyhedric shape, or of any other suitable shape.

3. The system for realizing complex constructions according to claim 1, wherein said basic elements provide not-magnetic coupling means provided according to a reference system x, y, z relative to the basic element, said not-magnetic coupling means being provided according to one or more of said axis x, y, z.

4. The system for realizing complex constructions according to claim 3, wherein said not-magnetic coupling means are comprised of threaded holes.

5. The system for realizing complex constructions according to claim 4, wherein said holes are comprised of threaded holes.

6. The system for realizing complex constructions according to claim 4, wherein said holes are comprised of fixed joint holes.

7. The system for realizing complex constructions according to claim 4, wherein said holes are through holes.

8. The system for realizing complex constructions according to claim 4, wherein said holes are blind holes.

9. The system for realizing complex constructions according to claim 1, wherein said first type of constructive and/or figurative elements is comprised of substantially elongated elements having at least their ends comprised of magnetic material.

10. The system for realizing complex constructions according to claim 9, wherein said first type of constructive and/or figurative elements is comprised of bars.

11. The system for realizing complex constructions according to claim 9, wherein structures or figures are provided on said substantially elongated elements.

12. The system for realizing complex constructions according to claim 1, wherein said second type of constructive and/or figurative elements are comprised of plastic material.

13. The system for realizing complex constructions according to claim 12, wherein said second type of constructive and/or figurative elements are comprised of rigid plastic material.

14. The system for realizing complex constructions according to claim 12, wherein said second type of constructive and/or figurative elements are comprised of flexible plastic material.

15. The system for realizing complex constructions according to claim 12, wherein second type of constructive and/or figurative elements has a substantially elongated shape.

16. The system for realizing complex constructions according to claim 12, wherein said second type of constructive and/or figurative elements has the shape of an object, of a personage, of a figure, or of part of the same.

17. The system for realizing complex constructions according to claim 1, wherein said not-magnetic coupling means are comprised of a fixed joint provided on said second type of constructive and/or figurative elements, coupling outside said basic element.

18. The system for realizing complex constructions according to claim 1, wherein shaped elements are provided, coupling with said first and/or second type of constructive and/or figurative elements or with said basic elements, or with a combination of the same, partially or completely reproducing a figure or element, or part of the same.

19. The system for realizing complex constructions according to claim 1, wherein elements are provided that can be fixedly coupled outside said basic elements.

20. The system for realizing complex constructions according to claim 18, wherein said elements are comprised of plastic material.

21. The system for realizing complex constructions according to claim 1, wherein basic elements with different dimensions are provided.

22. The system for realizing complex constructions according to claim 1, wherein basic elements provided with a through hole are provided, said hole being sized in such a way to fit outside said substantially elongated shape second type of constructive and/or figurative elements.

23. The system for realizing complex constructions according to claim 1, wherein it provides constructive and/or figurative elements comprised of a flexible elongated element, that can be introduced within the holes of said basic elements, shaped or figurative elements being provided that can be inserted outside said flexible elongated element.

24. The system for realizing complex constructions according to claim 1, wherein the system provides a substantially bidimensional base, shaped or not shaped, or a base, shaped or not shaped with a thickness substantially lower with respect to the other two dimensions, and provided with seats for fixed or removable coupling of said basic elements.

25. The system for realizing complex constructions according to claim 1, wherein it provides a substantially bidimensional base, shaped or not shaped, or a base, shaped or not shaped with a thickness substantially lower with respect to the other two dimensions, and provided with basic elements directly built in the same base.

26. The system for realizing complex constructions according to claim 1, wherein said basic elements are comprised of steel, or of nickel-plated material.

* * * * *